US006637488B2

(12) United States Patent
Okamura

(10) Patent No.: US 6,637,488 B2
(45) Date of Patent: Oct. 28, 2003

(54) TAPE-SHEATHING DEVICE FOR AN ELECTRIC WIRE

(75) Inventor: Takahiro Okamura, Yokkaichi (JP)

(73) Assignee: Sumitomo Wiring Systems, Inc., Yokkaichi (JP)

( * ) Notice: Subject to any disclaimer, the term of this patent is extended or adjusted under 35 U.S.C. 154(b) by 178 days.

(21) Appl. No.: 09/832,103

(22) Filed: Apr. 11, 2001

(65) Prior Publication Data

US 2001/0030027 A1 Oct. 18, 2001

(30) Foreign Application Priority Data

Apr. 14, 2000 (JP) ..... 2000-112959

(51) Int. Cl.[7] ..... H01B 13/26

(52) U.S. Cl. ..... 156/463; 156/53; 156/54; 156/187; 156/465; 156/466; 156/468; 156/477.1; 29/728

(58) Field of Search ..... 156/53, 54, 56, 156/187, 361, 459, 461, 463, 465, 466, 468, 477.1; 29/728

(56) References Cited

U.S. PATENT DOCUMENTS 2,133,620 A * 10/1938 Isenberg ..... 156/463
4,252,584 A * 2/1981 Garner ..... 156/54
5,410,901 A * 5/1995 Robblee et al. ..... 72/176
6,119,749 A 9/2000 Matsuzawa

FOREIGN PATENT DOCUMENTS

JP 10-3831 1/1998
JP 10228825 8/1998

OTHER PUBLICATIONS

English Language Abstract of JP 10–3831.
English Language Abstract of JP 10–228825.

* cited by examiner

*Primary Examiner*—Sam Chuan Yao
*Assistant Examiner*—Jessica Rossi
(74) *Attorney, Agent, or Firm*—Greenblum & Bernstein, P.L.C.

(57) ABSTRACT

A tape-sheathing device is provided to eliminate peeling of a tape adhered to an electric wire, in which a first die, a second die and a third die having tapered holes are serially arranged. An electric wire fed by a feed roller and a tape are inserted together into respective dies, and the tape is installed incrementally on the electric wire by the respective dies. Opening portions are provided in the first die and the second die by notching a portion in the range of about 90° of the downstream end portions of the first and second dies, in a condition in which the opening in the first die and the opening in the second die are shifted by about 90° relative to each other. When the tape passes through the first die, it is adhered to a partial peripheral portion of the electric wire, adhered to about three quarters of the wire by passage through the second die, and adhered completely around the periphery by passage through the third die.

8 Claims, 7 Drawing Sheets

TAPE-SHEATHING DEVICE FOR AN ELECTRIC WIRE

BACKGROUND OF THE INVENTION

1. Field of the Invention

The present invention relates to a tape-sheathing device for an electric wire, and particularly to a device for adhering a shielding tape to an electric wire and sheathing the electric wire to form a shielded wire for use in wiring electronics instruments such as a copy machine, a facsimile machine and the like, as well as in an automobile.

2. Description of Background Information

In general, since an electric wire for transmitting and receiving a control signal is influenced by other transmitting and receiving signals due to the influence of outside noise, and may cause a requisite control to become unreliable, a shielded wire is often used for an electric wire for control and the like. The shielded wire is generally produced by wrapping an electric wire in an axial direction with adhesive shielding tape. The shielding tape is made of an electro-conductive aluminum tape to be provided along the electric wire.

As shown in FIG. 7, a die 1 is usually used for wrapping the above-mentioned shielding tape of on electric wire. The die 1 has a tapered hole 1*a*. By simultaneously inserting the electric wire d and the shielding tape T into the tapered hole 1*a*, the electric wire d is wrapped with the shielding tape T due to the diameter-reducing effect of the tapered hole 1*a*, and the shielding tape T is adhered around the electric wire d to form the shielded electric wire sd. However, since only one die is insufficient to apply the pressure required for winding, problems have occurred in that the appearance of a wound tape is not uniform, coating does not reach completely around the electric wire, and the inner electric wire d is exposed.

For the above-mentioned problems, the present applicant has already proposed a technology for adhering a shielding tape on an electric wire and positively adhering to decorate, using the tape-sheathing device 5 of Japanese Patent Publication (Unexamined) Hei No. 10-3831 shown in FIG. 8.

The tape-sheathing device 5 provides a pressure roller unit 7, including a combination of two pairs of pressure rollers 8–1, 8–2 and 9–1, 9–2 which are mutually orthogonal at the downstream side of the feeding direction. A die 6 having the tapered insertion hole 6*a* is arranged at the upstream side in the feeding direction of the electric wire d and the tape T. Concave grooves 8*a* and 9*a* through which the electric wire d and the tape T pass are provided in the outer peripheral faces of the respective pressure rollers 8–1, 8–2 and 9–1, 9–2.

The electric wire d and the tape T are continuously fed in the direction of the arrow in FIG. 8 from the upstream side to the downstream side, in a condition in which the adhesive face Ta confronts the electric wire d. The tape T wraps the electric wire d in a width direction after passing through the die 6. When passing through the two combinations of pressure rollers 8–1, 8–2 and 9–1, 9–2, the tape T is pressed in turn by the grooves 8*a* and 9*a* of the respective rollers in orthogonal directions and in a diameter direction, and is wrapped and adhered on the electric wire d, thereby forming the shielded electric wire sd.

However, as the above-mentioned tape-sheathing device 5 presses the tape T by the two combinations of pressure rollers 8–1, 8–2 and 9–1, 9–2, the precision of groove position becomes important. Namely, when deviations and the like occur at the confronting respective groove positions, there are problems that the pressing direction relative to the tape T deviates, the tape T cannot be adhesively wrapped on the electric wire d, and the tape T peels off due to insufficient adhesion of the finished shielded electric wire sd.

On the other hand, when processing precision and installation precision are improved so as not to shift the respective groove positions of the pressure rollers 8–1, 8–2 and 9–1, 9–2, operating costs increase and the cost of the device itself increases. Further, even if a pressure roller having improved precision is used, there is a fear that the grooves and the like become worn by use with the lapse of time and the precision is lowered. Further, there is also the problem that daily maintenance for maintaining the precision is required.

SUMMARY OF THE INVENTION

The present invention was developed considering the above-mentioned problems, and an object is to cohesively and positively adhere a tape on an electric wire without using a press roller that requires precision.

In order to achieve the above-mentioned object, the present invention provides a tape-sheathing device for an electric wire, of wrapping an electric wire in the width direction of the tape in a condition in which the longitudinal direction of the tape is situated along the axial direction of the electric wire and is adhered to the electric wire. The tape-sheathing device includes a plurality of dies, with each die having a tapered hole at the downstream side in a feeding direction. The electric wire and the tape are fed by a feeding device and are jointly inserted into a respective one of the plurality of dies, which dies are provided in a serial arrangement in the feeding direction. The tapered hole of each of the dies other than the final die in the feeding direction is provided with an opening formed by notching an outer peripheral portion thereof, and each of the dies having the opening is arranged in a position with the opening shifted out of alignment relative to the respective opening of an upstream die. Thus, the tape is adhered while being wrapped around a portion of the electric wire whenever the electric wire and the tape pass through the respective dies.

Thus, a plurality of dies are used and the role of the respective dies is clarified. Thus, a tape for shielding or the like is adhered in a stepwise fashion on an electric wire and can be adhered on the electric wire without using a pressure roller. Namely, there is no pressing force at a notched portion on the respective dies due to notching a portion around the tapered insertion hole. On the other hand, the pressing force at a portion that is not notched is relatively increased.

Accordingly, the respective dies equipped with the openings due to notching are arranged in serial order so that the positions of the respective openings are not aligned, and the tape is adhered in a stepwise fashion on the electric wire by using only the final die where the opening is not provided. Therefore, the tape can be positively adhered to the electric wire by finally pressing the entire periphery of the taped wire again. As a result, the tape does not peel from the finished electric wire, and a high quality product can be produced. Further, since the present device does not use a pressure roller which requires high precision, costs are reduced and required maintenance and the like are unnecessary once the respective dies are arranged.

As the establishment of the specific die of the present device, the above-mentioned plurality of dies include three dies, namely a first die, a second die and a third die. The first die and the second die have a notched portion over about 90° centering on the tapered hole in cross-section orthogonal to the axial direction at the outer peripheral portion of the downstream side in a feeding direction to provide openings in the tapered holes. The first die and the second die are arranged in a condition in which the respective openings are shifted relative to each other by about 90°.

In general, the width of the tape is established to be greater than the outer peripheral dimension of the electric wire so that the inner electric wire is not exposed once the tape has been adhered to the wire. Accordingly, as described above, the first die and the second die having the openings of about 90° are arranged so that the respective openings are shifted by about 90°, and the third die having no opening is arranged as the final die. Thus, the tape can be positively adhered in a stepwise fashion on the outer periphery of the electric wire. Further, since the first die and the second die are provided with the openings by notching only an outer peripheral portion in the downstream side in the feeding direction, the electric wire and the tape are guided by the tapered hole having no notch at the upstream side and can be positively guided to the tapered hole having the opening at the downstream side.

In particular, the tape is adhered on a portion of the periphery of the electric wire from a first end in the width direction by the passage through the first die, and the remaining portion including a second end is in a condition in which it is separated from the electric wire without being wrapped. Then, another portion not wrapping the electric wire is adhered to the electric wire leaving unwrapped the area of the second end, by the passage through the second die. The area of the second end is finally adhered by passage through the third die, overlapping the area of the first end which was previously adhered. The entire periphery of the electric wire is pressed again and the tape is adhered to the electric wire. Therefore, peeling of the tape from the completed electric wire can be eliminated.

In another aspect of the present invention, A tape-sheathing device for an electric wire is provided. The device includes a plurality of dies, each die having a tapered hole that tapers from a large diameter at an upstream end to a smaller diameter at a downstream end, the plurality of dies being arranged in series along an axial line in a feeding direction. Each die, except the most downstream die in the feeding direction, has a notch in a peripheral portion thereof that communicates with the tapered hole, and the notch of each die is arranged out of alignment, in a radial direction of the axial line, from the notch of each other die. Thus, tape passing through each die is caused to be successively wrapped about only a portion of the electric wire as the tape and the electric wire pass through the series of dies, and the tape is completely wrapped by the most downstream die.

In other aspects of the present invention, the notch of each die of the tape-sheathing device may extend around about one quarter of the periphery of each die. Additionally, the plurality of dies may include first, second, and third dies, with the notches being provided in only the first and second dies. Moreover, each notch may extend around about one quarter of the periphery of each the die, and the notches may be aligned to be shifted about 90° with respect to each other about the axial line.

BRIEF DESCRIPTION OF DRAWING

FIGS. 3(A)–3(C) show the construction of the first die and the second die, wherein FIG. 3(A) is a perspective view, FIG. 3(B) is an end view and FIG. 3(C) is a cross-sectional view.

FIGS. 4(A)–4(C) show the construction of the third die, wherein FIG. 4(A) is a perspective view, FIG. 4(B) is an end view and FIG. 4(C) is a cross-sectional view.

FIGS. 5(A)–5(C) depict the arrangement of the first die, the second die and the third die, wherein FIG. 5(A) depicts the complete arrangement, FIG. 5(B) is a view from the downstream side in the feeding direction showing the mounting position of the first die, and FIG. 5(C) is a view from the downstream side in the feeding direction showing the mounting position of the second die.

FIGS. 6(A) and 6(B) depict the operation of adhering a tape after passage through the first die, the second die and the third die, respectively, wherein FIG. 6(A) is a schematic perspective view and FIG. 6(B) is a view from the downstream side in the feeding direction.

DETAILED DESCRIPTION OF THE PREFERRED EMBODIMENTS

The mode of operation of the present invention is described below with reference to drawings.

Figure 1:
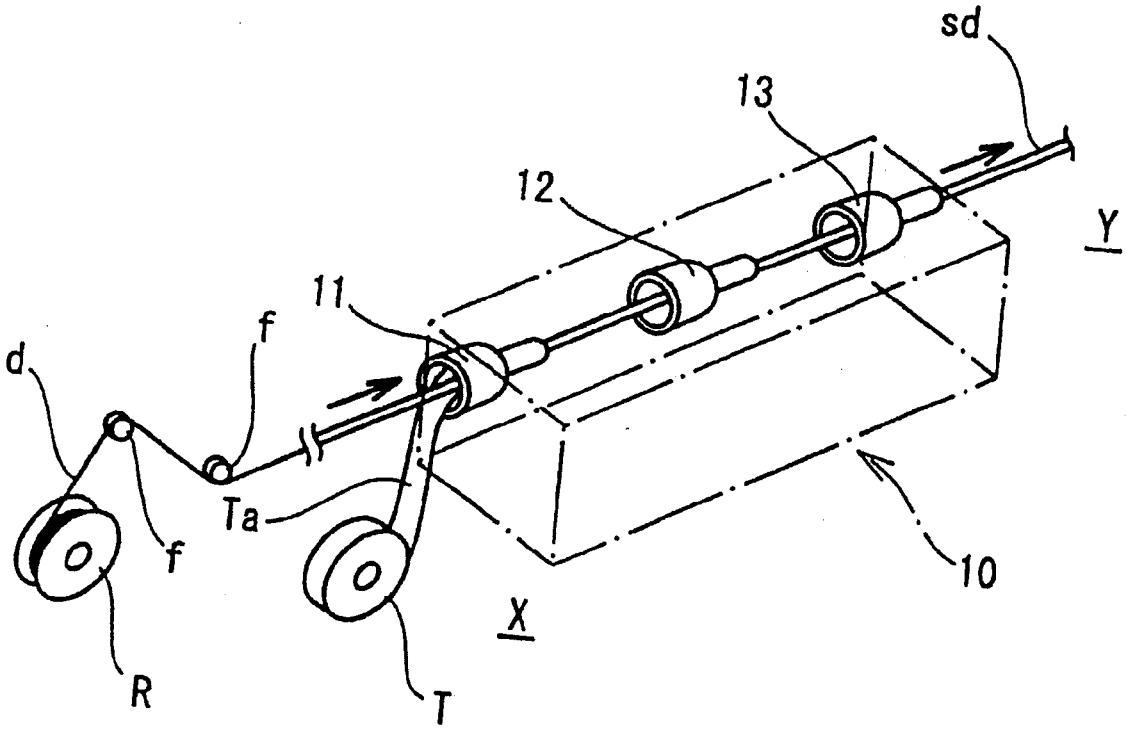
FIG. 1 is a schematic perspective view of the tape-sheathing device according to an embodiment of the present invention.

FIG. 1 schematically shows the complete arrangement of the tape-sheathing device 10 for an electric wire related to the present invention. The present device 10 serially arranges a first die 11, a second die 12 and a third die 13 at intervals. The electric wire d and the tape T, which is wound on the reel R, is positioned at the upstream side X in the feeding direction, and the electric wire d is pulled from the reel R by the feed roller f in a feeding procedure. Further, another feed roller (not illustrated) is positioned at the downstream side Y of the present device 10, and the electric wire d and the tape T are continuously fed from the upstream side X to the downstream side Y.

Further, according to the present embodiment of the invention, a shielding tape is used for the tape T, and the present device 10 is utilized in a process of producing the shielded electric wire sd. The tape T includes a thin film layer of a polyethylene that is formed on one side or both sides of a soft aluminum tape having a thickness of about 0.2 mm to provide a shielding effect, and an adhesive face Ta is formed on one face thereof. The adhesive face Ta is situated along, and confronts the electric wire, and the tape T is configured to be adhered around the electric wire d.

Figure 2:
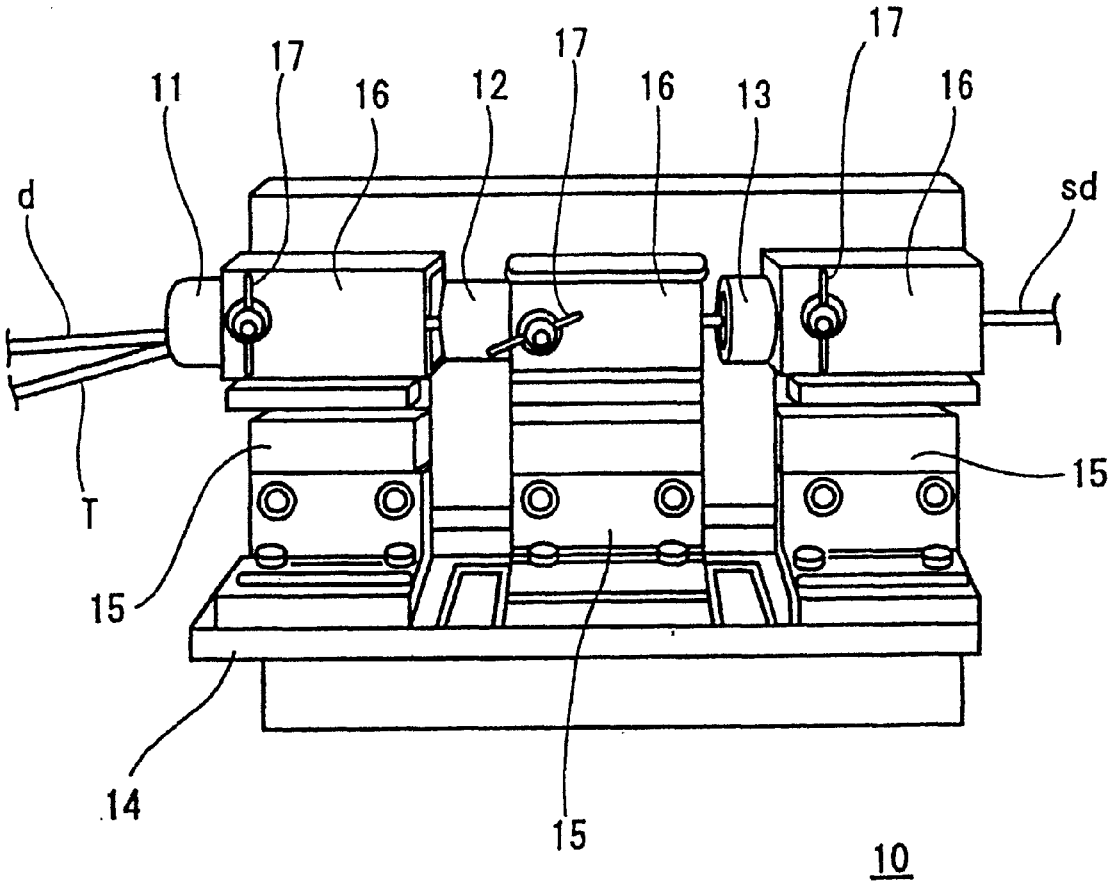
FIG. 2 is a schematic view showing a condition in which the tape-sheathing device is installed.

FIG. 2 depicts the arrangement of the dies of the tape-sheathing device 10 for an electric wire. The present device 10 includes holders 16 having thumb screws 17 provided on the upper part of brackets 15 which extend upwardly from a base plate 14 that is configured to arrange the respective dies. The holders 16 have a hollow configuration in which the respective dies are mounted from the outside, and the dies are retained in the holders 16 by screwing in the thumb screws 17.

Figure 3:
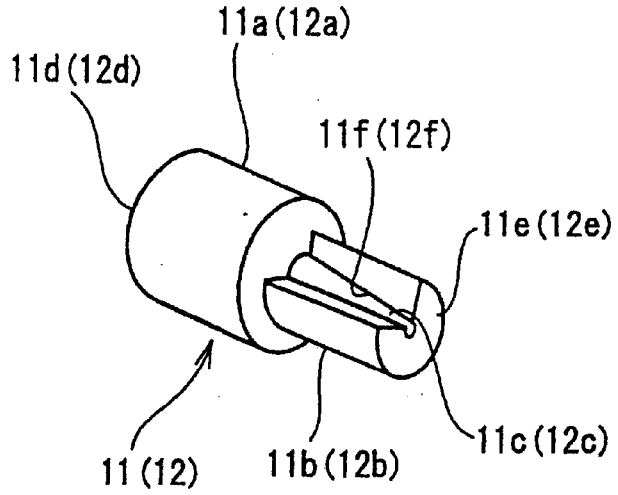
Figure 3:
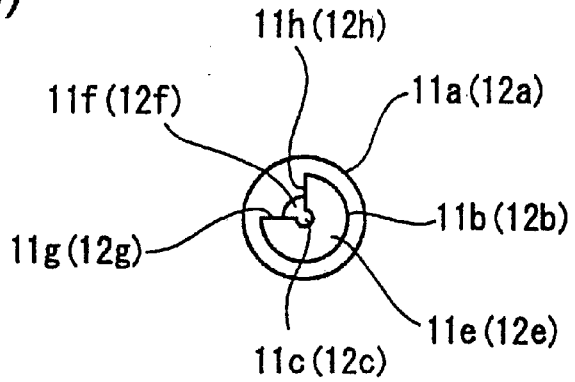
Figure 3:
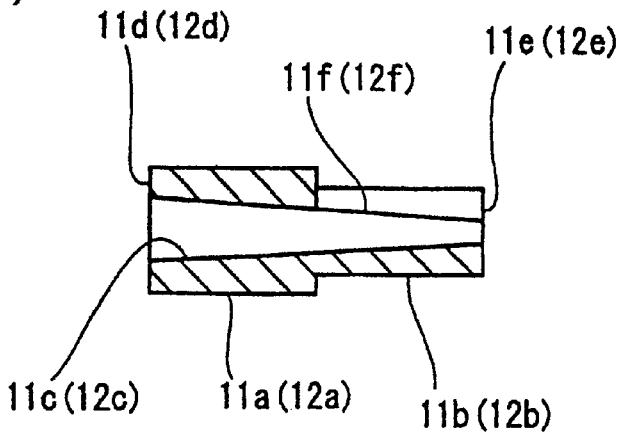

FIGS. 3(A), 3(B) and 3(C) depict different views of the first die 11 and the second die 12, and the first die 11 and the second die 12 have the same generally columnar shape. The outer shape of the part corresponding to the upstream side in the feeding direction includes large diameter tubular portions 11*a* (12*a*), and the outer shape of the part corresponding to the downstream side in the feeding direction includes small diameter tubular portions 11*b* (12*b*). The small diameter tubular portions 11*b* (12*b*) are configured to be mounted by being inserted into the holders 16 from outside. Further, tapered holes 11*c* (12*c*) are provided in the interior to extend continuously from the large diameter tubular portions 11*a* (12*a*) to the small diameter tubular portions 11*b* (12*b*).

The tapered holes 11*c* (12*c*) have an inner diameter for positively guiding the tape T which is not wrapped at first end faces 11*d* (12*d*) on the upstream side and is flat and not adhered. On the other hand, at the second end faces 11*e* (12*e*) on the downstream side, the inner diameter is configured to be about equal to the diameter of a fixed shielded electric wire, and the inner diameter is gradually reduced from the first end faces 11*d* (12*d*) to the second end faces 11*e* (12*e*). Further, the small diameter tubular portions 11*b* (12*b*) having the tapered holes 11*c* (12*c*) are notched by cutting the outer peripheral portion within a range of about 90° centering on the tapered holes 11*c* (12*c*), which is about one quarter of the circular second end faces 11*e* (12*e*), as shown in FIG. 3(B), and provides openings 11*f* (12*f*).

Figure 4:
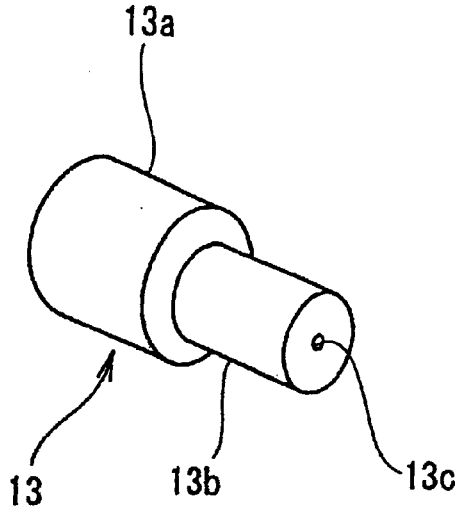
Figure 4:
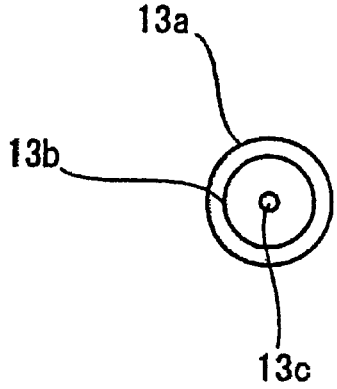
Figure 4:
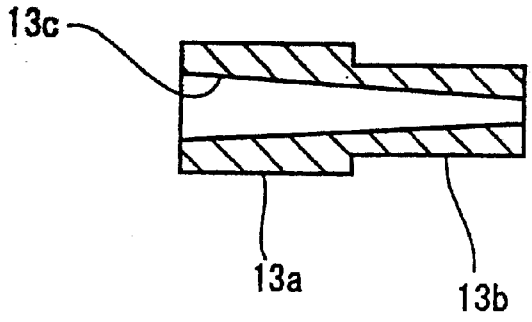

FIGS. 4(A)–4(C) depict different views of the third die 13, which is similar to the first die 11 and the second die 12, but does not include a notched portion, which is different from the first die 11 and the second die 12. Except for that, the tapered hole 13*c* is provided on the inside to extend from the large diameter tubular portion 13*a* to the small diameter tubular portion 13*b* in like manner to the first die 11 and the second die 12. Further, in a preferred embodiment of the present invention, the respective dies are formed of resin material, but the dies may be formed from a metal, or any other suitable material.

Figure 5:
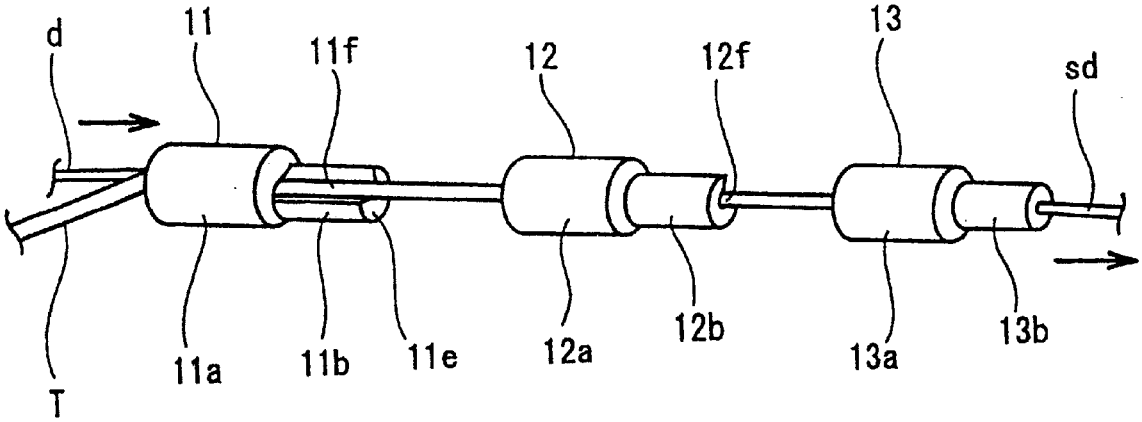
Figure 5:
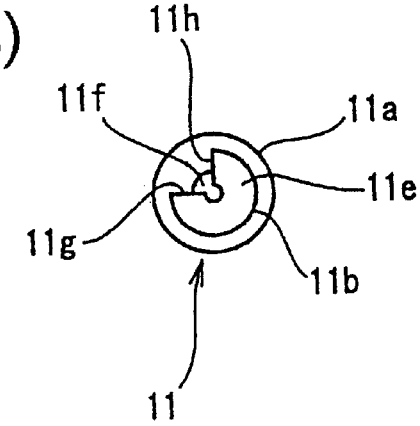
Figure 5:
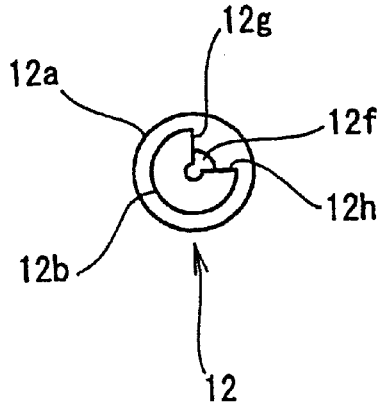

The first die 11, the second die 12 and the third die 13 are arranged from the upstream side to the downstream side in the positional relationship as shown in FIG. 5(A). An important point in the above-mentioned positional relation is the position of the opening 11*f* of the first die 11 relative to the opening 12*f* of the second die 12. The positions of the opening 11*f* and opening 12*f* are not aligned, and the first die 11 and the second die 12 are fixed by installation within the holders 16 shown in FIG. 2 in a condition in which they are rotated by 90°. In the present mode of operation, considering that the tape T is adhered from the lower side of the electric wire d, the first die 11 is arranged in a condition in which the respective orthogonal faces 11*g* and 11*h* are positioned in a 9 o'clock condition when the second end face 11*e* is viewed from the downstream side in the feeding direction, as shown in FIG. 5(B). On the other hand, the second die 12 is mounted so that the respective orthogonal faces 12*g* and 12*h* are positioned in a 3 o'clock condition by rotating the second die 12 relative to the first die 11 by 90° in the clock-wise direction, as shown in FIG. 5(C). Thus, the opening 11*f* and the opening 12*f* are positioned in a condition in which they are shifted by 90°.

The process of producing the shielded electric wire sd by passing the electric wire d and the tape T into the first die 11, the second die 12 and the third die 13 of the present device 10 is further described in detail below.

First, the longitudinal direction of the tape T is aligned with the axial direction of the electric wire d, the tape T is positioned below and along the electric wire d and passed from the first die 11 to the third die 13, and the electric wire d and the tape T are continuously fed by the feed rollers.

Figure 6:
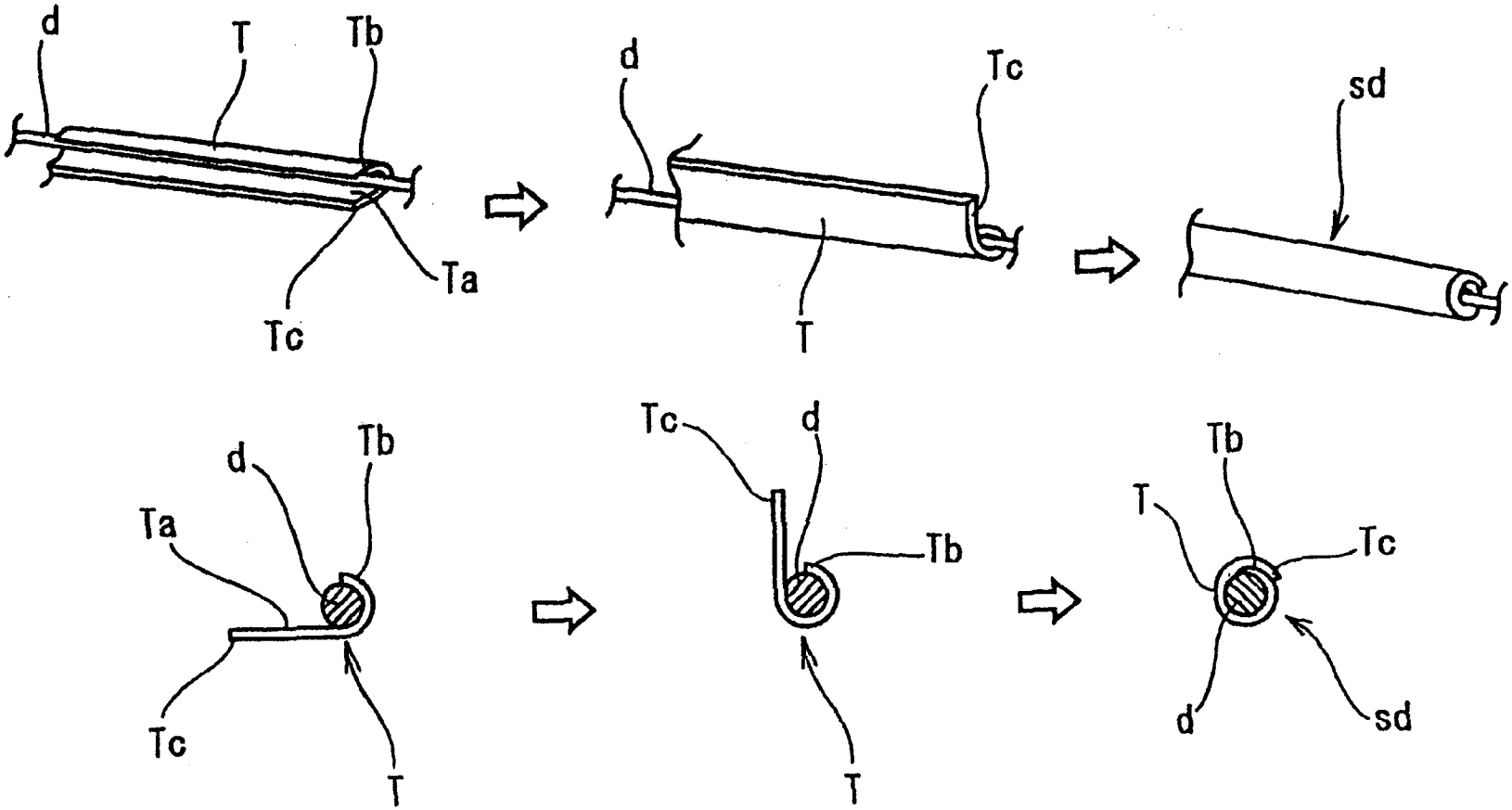
Figure 7:
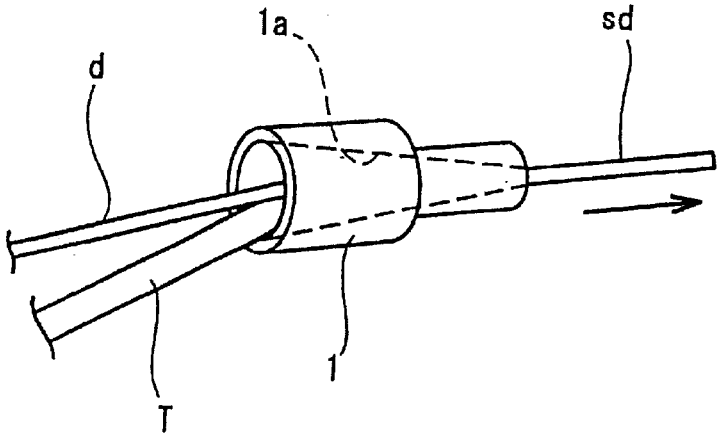
Fig. 7 PRIOR ART
FIG. 7 is a schematic perspective view showing the operation of a conventional tape-sheathing.
Figure 8:
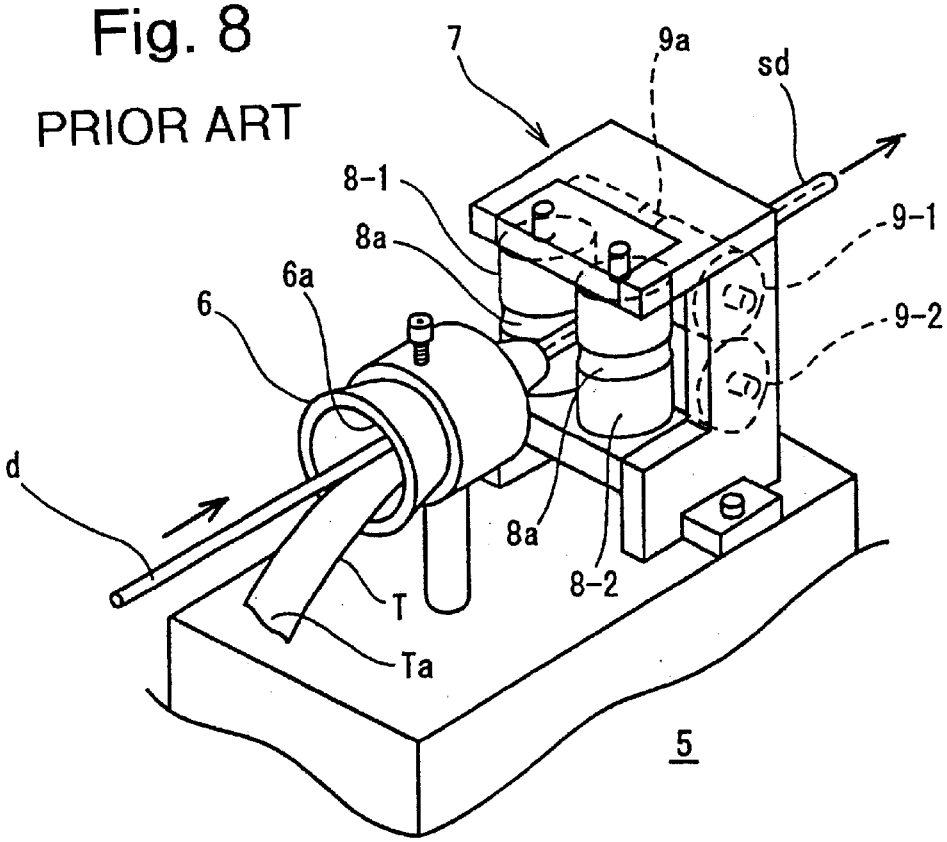
Fig. 8 PRIOR ART
FIG. 8 is a perspective view of another conventional tape-sheathing device.

As shown in FIGS. 6(A) and 6(B), when the tape T passes through the first die 11, it wraps the electric wire d by the taper hole 11 *c*, is adhered by the adhesive face Ta, and the tape T is adhered to the electric wire d by being wound from one end Tb as if being wrapped. However, since the pressing force is not applied to the portion where the tape T passes through the opening 11*f*, that portion of the tape T is not wrapped onto the electric wire d, and passes through the first die 11 in a position extending along the face 11*g* which is situated to a horizontal direction of the opening 11*f*.

Accordingly, the condition in which the tape is adhered after passage through the first die 11 is in a condition in which one vertical half of the electric wire d, coinciding with a part where the peripheral wall of the tapered hole 11*c* exists, is wrapped by the part containing the one end Tb of the tape T, as shown in the left-hand portion of FIG. 6(B). Further, since the pressing force by the remaining peripheral wall of the tapered hole 11*c* is relatively increased by the opening part 11*f*, the above-mentioned part adhered to the tape is positively adhered to the electric wire d.

Then, when the tape T passes through the second die 12, the portion not adhered to the tape T wraps the electric wire d along the face 12*g* positioned in a vertical direction and passes through the second die 12 because the location of the opening 12*f* is shifted by 90°. Therefore, as a result, the portion corresponding to three quarters of the electric wire d is wrapped by the tape T as shown in the middle position of FIG. 6(B). Further, together with the passage through the second die 12, the tape portion adhered to the electric wire d is newly and strongly adhered to the electric wire d by the pressing force relatively increased by the opening 12*f*.

Finally, when the tape passes through the third die 13, the portion of the tape T not adhered during passage through the second die 12 is wrapped on the electric wire d along the peripheral wall of the tapered hole 13*c* because the third die 13 is not provided with a side opening. One portion of the tape T including another end portion Tc is adhered in an overlapping arrangement to the portion including the end portion Tb which was previously adhered, and positively covers the tape T so that the electric wire d is not exposed, as shown in the right-hand portion of FIG. 6(B). Further, since the portion Tb previously adhered to the electric wire d is also pressed again by passage through the third die 13 and adhered to the electric wire d, the entire tape T is strongly adhered to the electric wire d, and the completed shielded electric wire sd eliminates peeling of the tape T.

Thus, in the above-described embodiment, the tape T is adhered to the electric wire d in three steps using three dies. Therefore, the adhering of the tape T becomes positive. For example, the percent of the finished product that is defective due to tape-peeling was 3.0% in case of a conventional tape-sheathing by one die, but the percent of defective product due to tape-peeling became 0% as a result of the introduction of the present device.

Further, the present invention is not limited to the above-described mode of operation, and can be appropriately changed in accordance with the diameter of the electric wire and the width of the tape applied. For example, it is possible to adhere a tape to an electric wire in finer increments using more than three of the dies. Further, when the numbers of the dies are increased, the opening width of the opening is not limited to 90° and may be appropriately increased or decreased. It is also unnecessary to make the opening widths of the respective dies same. Further, it is not always necessary to respectively shift all parts of the openings of the respective dies, and there is no problem that portions of the openings are arranged so as to be overlapped. Also, it is also possible for the direction in which the openings are serially shifted to be the counter-clockwise direction. Further, the respective dies may be continuously arranged without any interval therebetween.

As is clear from the above description, with the tape-sheathing device for an electric wire of the present invention, the degree of adhesion is improved and defects in a finished product caused by tape-peeling can be eliminated because a tape can be sheathed by being adhered in steps to the electric wire. Further, since the present device does not use a pressure roller requiring high precision, the costs for the device can be reduced. Additionally, because the device has few movable parts, maintenance problems and the like are minimized and a stable serial tape-sheathing operation can be provided.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presented stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present application claims priority under 35 U.S.C. §119 of JP2000-112959, filed on Apr. 14, 2000, the disclosure of which is expressly incorporated by reference herein in its entirety.

What is claimed is:

1. A tape-sheathing device for an electric wire, said device comprising: a plurality of dies, each die including a tapered hole that tapers from a large diameter at an upstream end to a smaller diameter at a downstream end, said plurality of dies being arranged in series along an axial line in a feeding direction;

each die, except the most downstream die in the feeding direction, having a notch therein extending from said tapered hole to an outer periphery thereof that communicates with said tapered hole, and wherein the notch of each die is arranged out of alignment, in a radial direction of the axial line, from the notch of each other die;

whereby tape passing through each die is caused to be successively wrapped about only a portion of the electric wire as the tape and the electric wire pass through the series of dies, and the tape is completely wrapped by said most downstream die.

2. The tape-sheathing device according to claim 1, wherein each said notch extends around about one quarter of the periphery of each said die.

3. The tape-sheathing device according to claim 1, wherein said plurality of dies comprise first, second, and third dies, said notches being provided in only said first and second dies.

4. The tape-sheathing device according to claim 3, wherein each said notch extends around about one quarter of the periphery of each said die.

5. The tape-sheathing device according to claim 4, wherein said notches are aligned to be shifted about 90° with respect to each other about the axial line.

6. A tape-sheathing device for an electric wire, in which a sheath tape is adhered to an electric wire by wrapping the electric wire in a width direction of the tape so that a longitudinal tape direction is aligned along an axial direction of the electric wire, said tape-sheathing device comprising:

a plurality of dies, each die having a tapered hole in the downstream side in a feeding direction, provided in series in the feeding direction, wherein the electric wire and the tape are jointly fed together by a feeding device through said plurality of dies;

said tapered hole of each die, other than the final die in the feeding direction, is provided with an opening formed by notching and extending from said tapered hole to an outer periphery of said die, and each die having said opening is arranged in a position with said opening shifted out of alignment relative to the respective opening of an upstream die;

whereby the tape is adhered while being wrapped around a portion of the electric wire whenever the electric wire and the tape pass through the respective dies.

7. The tape-sheathing device for an electric wire according to claim 6, wherein said plurality of dies comprises three dies including a first die, a second die, and a third die, said first die and said second die having said openings in the tapered holes formed by notching a portion of about 90° centering on said tapered hole in cross-section orthogonal to the axial direction at the outer peripheral portion of the downstream side in a feeding direction, and said first die and said second die are arranged so that the respective openings are shifted relative to each other by about 90°.

8. A tape-sheathing device for an electric wire, in which a sheath tape is adhered to an electric wire by wrapping the electric wire in a width direction of the tape so that a longitudinal tape direction is aligned along an axial direction of the electric wire, said tape-sheathing device comprising:

a plurality of dies, each die having a tapered hole in the downstream side in a feeding direction, provided in series in the feeding direction, wherein the electric wire and the tape are jointly fed together by a feeding device through said plurality of dies;

said tapered hole of each die, other than the final die in the feeding direction, is provided with an opening formed by notching an outer peripheral portion thereof, and each die having said opening is arranged in a position with said opening shifted out of alignment relative to the respective opening of an upstream die;

whereby the tape is adhered while being wrapped around a portion of the electric wire whenever the electric wire and the tape pass through the respective dies; and wherein said plurality of dies comprises three dies including a first die, a second die, and a third die, said first die and said second die having said openings in the tapered holes formed by notching a portion of about 90° centering on said tapered hole in cross-section orthogonal to the axial direction at the outer peripheral portion of the downstream side in a feeding direction, and said first die and said second die are arranged so that the respective openings are shifted relative to each other by about 90°.

* * * * *

UNITED STATES PATENT AND TRADEMARK OFFICE

CERTIFICATE OF CORRECTION

PATENT NO. : 6,637,488 B2
DATED : October 28, 2003
INVENTOR(S) : T. Okamura

It is certified that error appears in the above-identified patent and that said Letters Patent is hereby corrected as shown below:

Title page,
Item [73], Assignee, "Inc." should read be -- Ltd. --.

Signed and Sealed this

First Day of June, 2004

JON W. DUDAS
*Acting Director of the United States Patent and Trademark Office*